United States Patent [19]

Diewald

[11] 4,170,178

[45] Oct. 9, 1979

[54] DETONATOR CONTAINING OCTOGEN CRYSTALS FOR PROJECTILES AND METHOD OF MANUFACTURING THE SAME

[75] Inventor: Günther Diewald, Zürich, Switzerland

[73] Assignee: Werkzeugmaschinenfabrik Oerlikon-Bührle, Zurich, Switzerland

[21] Appl. No.: 859,647

[22] Filed: Dec. 12, 1977

[30] Foreign Application Priority Data

Dec. 21, 1976 [CH] Switzerland ..... 16081/76

[51] Int. Cl.[2] ..... C06C 7/00; C06C 7/02

[52] U.S. Cl. ..... 102/29; 86/1 R; 102/205; 149/92; 149/111

[58] Field of Search ..... 86/10, 1 R; 102/29, 102/205; 149/92, 111

[56] References Cited

U.S. PATENT DOCUMENTS

| | | | |
|---|---|---|---|
| 1,950,019 | 3/1934 | Biazzi | 102/29 |
| 2,617,326 | 11/1952 | Morris | 86/1 R |
| 3,340,808 | 9/1967 | Leopold | 149/92 |
| 3,351,585 | 11/1967 | Lee et al. | 149/92 |
| 3,428,502 | 2/1969 | Evans | 149/92 |
| 3,770,721 | 11/1973 | Robbins et al. | 149/92 |
| 3,943,017 | 3/1976 | Wells | 149/92 |
| 4,050,347 | 9/1977 | Adelman et al. | 86/1 R |

*Primary Examiner*—Edward A. Miller
*Attorney, Agent, or Firm*—Werner W. Kleeman

[57] ABSTRACT

A detonator containing octogen crystals for projectiles for initiating detonation or for the transmission of a detonation, wherein the octogen crystals possess a size greater than 75 microns and smaller than 150 microns, the relationship between the length and diameter of the crystals amounts to about 3:1, and the edges of the crystals are undamaged. To produce the detonator cap a mixture of different types of octogen crystals is enriched with the aforementioned size of preferred octogen crystals by wet sieving.

7 Claims, 7 Drawing Figures

Fig. 1
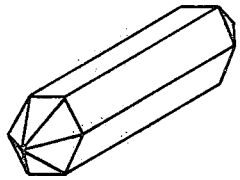
Fig. 2
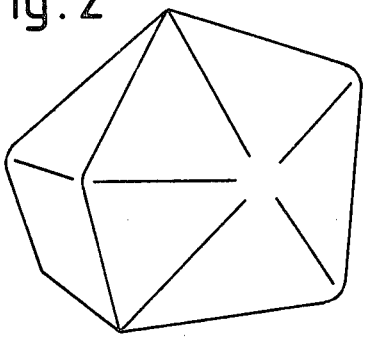
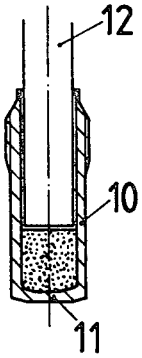
Fig. 3
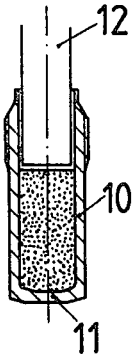
Fig. 4
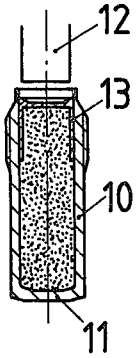
Fig. 5
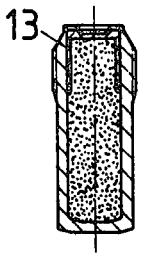
Fig. 6
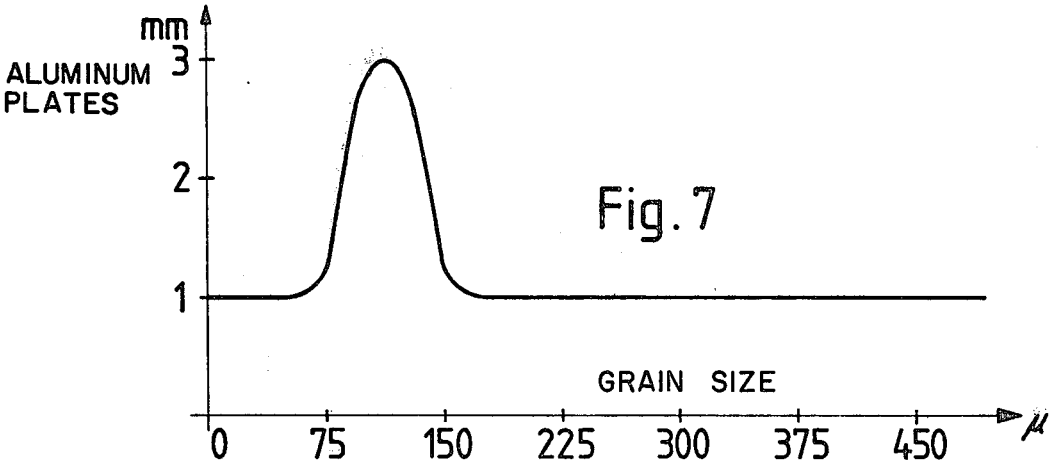
Fig. 7

DETONATOR CONTAINING OCTOGEN CRYSTALS FOR PROJECTILES AND METHOD OF MANUFACTURING THE SAME

BACKGROUND OF THE INVENTION

The present invention relates to a new and improved reinforcement charge-detonator cap, more generally referred to as a detonator, containing octogen crystals for projectiles for the purpose of initiating detonation or for transmitting or propagating a detonation, and further, the invention pertains to a method of manufacturing such detonator.

It has been found that prior art detonator caps or detonators of the aforementioned type for reinforcement charges are not all equally reliable for initiating detonation.

SUMMARY OF THE INVENTION

Therefore, it is a primary object of the present invention to provide an improved construction of detonator whose detonation ignition capabilities are enhanced and the susceptibility to disturbance in operation is reduced.

Yet a further significant object of the present invention aims at a novel method of producing such type detonator.

Now in order to implement these and still further objects of the invention, which will become more readily apparent as the description proceeds, the detonator of the present invention is manifested by the features that the octogen crystals have a size greater than 75 $\mu$ and smaller than 150 $\mu$, the ratio of the length-to-diameter of the crystals amounts to about 3:1, and that the edges of the crystals are undamaged.

Preferably the explosive charge of octogen at one end of the detonator has a greater density than at the other end, the density decreasing in a stepwise or incremental manner and at the other end of such cap the density is so small that the crystals remain completely intact i.e., undamaged or unchanged.

Further, at least 30 percent of the crystals of the octogen preferably have the aforementioned properties.

Not only is the invention concerned with the improved detonator but also pertains to a method of manufacturing the same. This method of producing the detonator of the invention contemplates enriching a mixture of different types of octogen crystals with a quantity of crystals having the preferred characteristics noted above by wet sieving.

Tests have shown that the detonation initiation capability of octogen is dependent upon the shape and size of the crystals, and to the extent possible such crystals should remain unchanged or undamaged.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIGS. 1 and 2 are respective views of octogen crystals;

FIGS. 3, 4, 5 and 6 respectively show different steps of the method for producing a detonator according to the invention; and FIG. 7 is a graph showing the detonation initiation capability of a detonator cap producing according to the teachings of the present invention.

DETAILED DESCRIPTION OF THE PREFERRED EMBODIMENTS

Describing now the drawings, in FIG. 1 there is illustrated a crystal of what is known in the art as octogen, an explosive, wherein such crystal has a size greater than 75 $\mu$ or less than 150 $\mu$ and the ratio of the length to the diameter of such crystal is about 3:1.

In contrast thereto there has been shown on the same scale in FIG. 2 an octogen crystal of a size larger than 150 $\mu$. Additionally, such crystal does not possess the desired length-diameter ratio of about 3:1, and therefore, equally does not have the requisite detonation initiation capability.

What is essential for good detonation initiation is that the crystals are undamaged. By sieving, especially wet sieving, it is possible to eliminate crystals which are both too large and too small. What is more difficult is the sorting of the octogen crystals according to their shape. Yet, microscopic observation of the octogen crystals has shown that the elongate crystals are smaller than the crystals which tend to be more spherical shaped, so that it is possible to obtain an enrichment of elongate crystals by wet sieving. The crystals are basically damaged by large pressures. If as many of the crystals as possible should remain undamaged, then the pressures which are applied during filling of the detonator should not exceed certain values.

Now during the production of the detonator of the invention, and as shown in FIG. 3, a quantity of about 140 mg. octogen is pressed at a pressure of about 12 atmospheres excess pressure with the aid of a punch 12 or other suitable pressing tool into a sleeve 10 having a floor or bottom 11.

As shown in FIG. 4 thereafter a further quantity of again approximately 140 mg. octogen is pressed into the same sleeve 10 at a lower pressure of about 6 atmospheres excess pressure.

FIG. 5 shows how thereafter a final quantity of again about 140 mg octogen is pressed into such sleeve 10 at a still smaller pressure of about 2 atmospheres excess pressure.

FIG. 6 illustrates closure of the sleeve or casing 10 by a cover 13 or equivalent structure and flanging of the upper edge of the sleeve 10, there being required for this operation a pressure of about 20 atmospheres excess pressure.

Octogen or more specifically referred to as either
homocyclonite or
tetramethylenetetranitramine or
HMX or
cyclotetramethylenetetramine has the following formula:

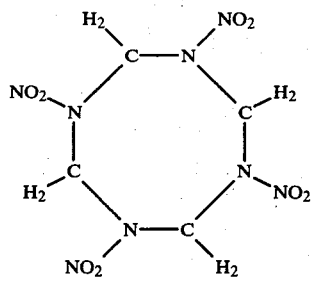

There are four modifications ($\alpha$, $\beta$, $\gamma$, $\delta$-modifications.)

Melting point 280° C.

Explosion heat 1228 cal/g (vaporous $H_2O$)

Detonation velocity 9100 m/sec.

Detonation temperature 287° C.

The $\beta$-modification is used for the reinforcement charge-detonator cap or detonator of the invention.

With careful sieving operations it is possible to strive to obtain the preferred crystaline shapes with a great degree of purity. By virtue of the low pressures which are employed during the filling of the second and third quantities of octogen, as shown in FIGS. 4 and 5, the crystals are less damaged, and thus the detonation initiation capability is greater. It is possible to check such detonation initiation capability with special test procedures and equipment.

From the graph of FIG. 7 it will be apparent that the detonation initiation capability is dependent upon the grain size. During the test procedure one, two or three small aluminum plates were inserted between an ignition cap and the detonator which is to be tested. In the presence of good detonation initiation capability the detonator cap cap can still be detonated with three plates. On the other hand, if the charge has poor detonation initiation capability then already a single plate prevents ignition of the reinforcement charge.

By wet sieving it is possible to enrich a mixture of different types of octogen crystals with at least 30 percent of a quantity of crystals of a size between 75 $\mu$ to 150 $\mu$ and having a length to diameter ratio of about 3:1.

While there are shown and described present preferred embodiments of the invention, it is to be distinctly understood that the invention is not limited thereto, but may be otherwise variously embodied and practiced with the scope of the following claims. ACCORDINGLY,

What I claim is:

1. A detonator for projectiles for initiating or transmitting detonation, comprising:

an explosive charge of octogen containing a mixture of different sizes of octogen crystals including octogen crystals possessing a size greater than 75 microns and smaller than 150 microns;

the octogen crystals of such size having a ratio of the length to diameter of about 3:1 and essentially undamaged crystal edges.

2. The detonator as defined in claim 1, wherein:

the explosive charge contains at least 30 percent octogen crystals having the aforementioned size, length to diameter ratio and crystal edge properties.

3. The detonator as defined in claim 1, wherein:

the detonator includes a sleeve containing the explosive charge and having opposed ends;

the octogen at one end of the sleeve possessing a greater density than at the other end of the sleeve;

the density of the octogen incrementally decreasing from said one end to the other end of said sleeve; and the density of the octogen at said other end of the sleeve being so small that the crystals remain intact.

4. A method of manufacturing a detonator, comprising the steps of:

providing an explosive of a mixture of different sizes of octogen crystals; and enriching said mixture of different sizes of octogen crystals with a quantity of octogen crystals which have been wet sieved so as to possess a size of the sieved octogen crystals greater than 75 $\mu$ and smaller than 150 $\mu$, a length to diameter ratio of the sieved crystals of about 3:1 and undamaged crystal edges.

5. A method of manufacturing a detonator, comprising the steps of:

providing an explosive of a mixture of different sizes of octogen crystals;

enriching the mixture of different sizes of octogen crystals with a quantity of octogen crystals which have been processed so as to possess a crystal size which is greater than 75 $\mu$ and smaller than 150 $\mu$, a length to diameter ratio of the crystals of about 3:1 and undamaged crystal edges;

filling such enriched mixture into a sleeve; and closing said sleeve of the detonator.

6. The method as defined in claim 5, wherein:

the enriched mixture is filled into the sleeve such that the density of the octogen varies over the length of the sleeve.

7. The method as defined in claim 6, wherein:

the density of the octogen decreases over the length of the sleeve during filling thereof.

* * * * *